US005860832A

United States Patent [19]

Wayt et al.

[11] Patent Number: 5,860,832

[45] Date of Patent: Jan. 19, 1999

[54] METHOD FOR CONNECTING FLAT FLEXIBLE CABLE AND A CONNECTOR

[75] Inventors: Roger W. Wayt; Nathan J. Moore, both of Dearborn, Mich.

[73] Assignee: UT Automotive Dearborn, Inc., Dearborn, Mich.

[21] Appl. No.: 792,688

[22] Filed: Jan. 29, 1997

[51] Int. Cl.[6] ..... H01R 13/58

[52] U.S. Cl. ..... 439/465

[58] Field of Search ..... 439/465, 467

[56] References Cited

U.S. PATENT DOCUMENTS

| | | | |
|---|---|---|---|
| 3,691,509 | 9/1972 | Krol | 439/465 |
| 3,904,261 | 9/1975 | Cooney | 439/465 |
| 4,192,571 | 3/1980 | Strautz . | |
| 4,519,659 | 5/1985 | Shiino et al. | 439/465 |
| 4,679,877 | 7/1987 | Ahroni | 439/465 |
| 5,011,430 | 4/1991 | Haitmanek | 439/456 |
| 5,057,650 | 10/1991 | Urushibata et al. | 439/465 |
| 5,160,812 | 11/1992 | Takahashi et al. | 174/135 |
| 5,417,584 | 5/1995 | Knott | 439/460 |
| 5,569,050 | 10/1996 | Lloyd | 439/465 |

*Primary Examiner*—Gary Paumen
*Attorney, Agent, or Firm*—Howard & Howard

[57] ABSTRACT

Flat flexible cable includes at least one conductor with an insulating film disposed thereabout. The cable further includes an opening through the film not in contact with the conductor. A connector for use with the flat flexible cable, includes an opening and a means for retaining the cable within the opening. The opening receives the cable such that one end of the cable is within the connector. The means for releasably retaining the cable within the opening is disposed through the opening in the cable, so that any force on the cable is transferred to the connector.

9 Claims, 1 Drawing Sheet

METHOD FOR CONNECTING FLAT FLEXIBLE CABLE AND A CONNECTOR

TECHNICAL FIELD

The present invention relates to electrical connectors for flat flexible cables, and more particularly for an improved method for connecting flat flexible cable to a connector.

BACKGROUND OF THE INVENTION

Electrical connectors are used in a wide variety of applications to interconnect various electrical components. It is well known to use electrical connectors with flat flexible cable. Flat flexible cable has a plurality of spaced, parallel extending conductors which are encased in an insulating film. Typically, these connectors have some electrically conductive feature, such as a terminal, retained therein.

There are two general requirements for connecting the flat flexible cable to the connector. One is that an electrical connection must exist between the cable conductors and the terminals. The other is that a mechanical connection must exist between the cable and the connector. With respect to the mechanical connection, it is desirable to provide strain relief so that if a mechanical load is applied to the cable, the terminal does not separate from the cable.

Many different types of problematic strain relief devices have been proposed for various applications. Many of these devices include clamp mechanisms hold the cables within the connectors. Clamps have limited versatility and require additional parts be added to the housing. Oftentimes, the clamps place large compressive loads on the cable potentially causing damage to the components. If the clamping load is insufficient, the clamps do not provide the necessary strain relief Adhesives have been used to bond the cable to the connector. This solution however does not work with all types of cable due to the composition of the film. If the film is incompatible with the adhesive, the necessary strain relief will not be provided. Adhesives are also expensive and are not a desired manufacturing process. Additionally, many of the existing strain relief devices require the cable to be routed along a tortuous path, often resulting in the housing of the device being enlarged or not providing sufficient strain relief.

Connectors can also provide strain relief by using the terminals to provide the mechanical as well as the electrical connection between the conductor and the connector. This solution does not provide the optimal electrical connection, since the termination is usually not gas tight and involves minimal copper contact.

In addition, the cable can be molded into the connector. This presents the problems of requiring a complex manufacturing process with sensitive parameters. This manufacturing process requires slow speeds and an expensive connector material.

In light of the aforementioned connectors, an improved connector is sought, which provides strain relief without degrading the electrical connection.

SUMMARY

Flat flexible cable includes at least one conductor with an insulating film disposed thereabout. A connector includes a housing with at least one projection extending from one side of the housing, and at least one slot for receiving each projection. A method for connecting the flat flexible cable to the connector includes the steps of forming at least one opening through the cable film without contacting the conductor, disposing the cable within the housing, and passing the projection through the opening, so that a portion of the projection is disposed within the respective slot. Due to the projection passing through the cable and being retained in the slot, if a load is applied to the cable, the load is transferred to the connector through the projection. Terminals or the like may be provided within the connector for making the electrical connection with the conductor. The method allows the electrical connection between the terminal and the conductor to be independent of the mechanical connection. Since the projection does not contact the conductors, the electrical connection is undisturbed.

The foregoing invention will become more apparent in the following detailed description of the best mode for carrying out the invention and in the accompanying drawings.

BEST MODE FOR CARRYING OUT AN EMBODIMENT THE INVENTION

Figure 1:
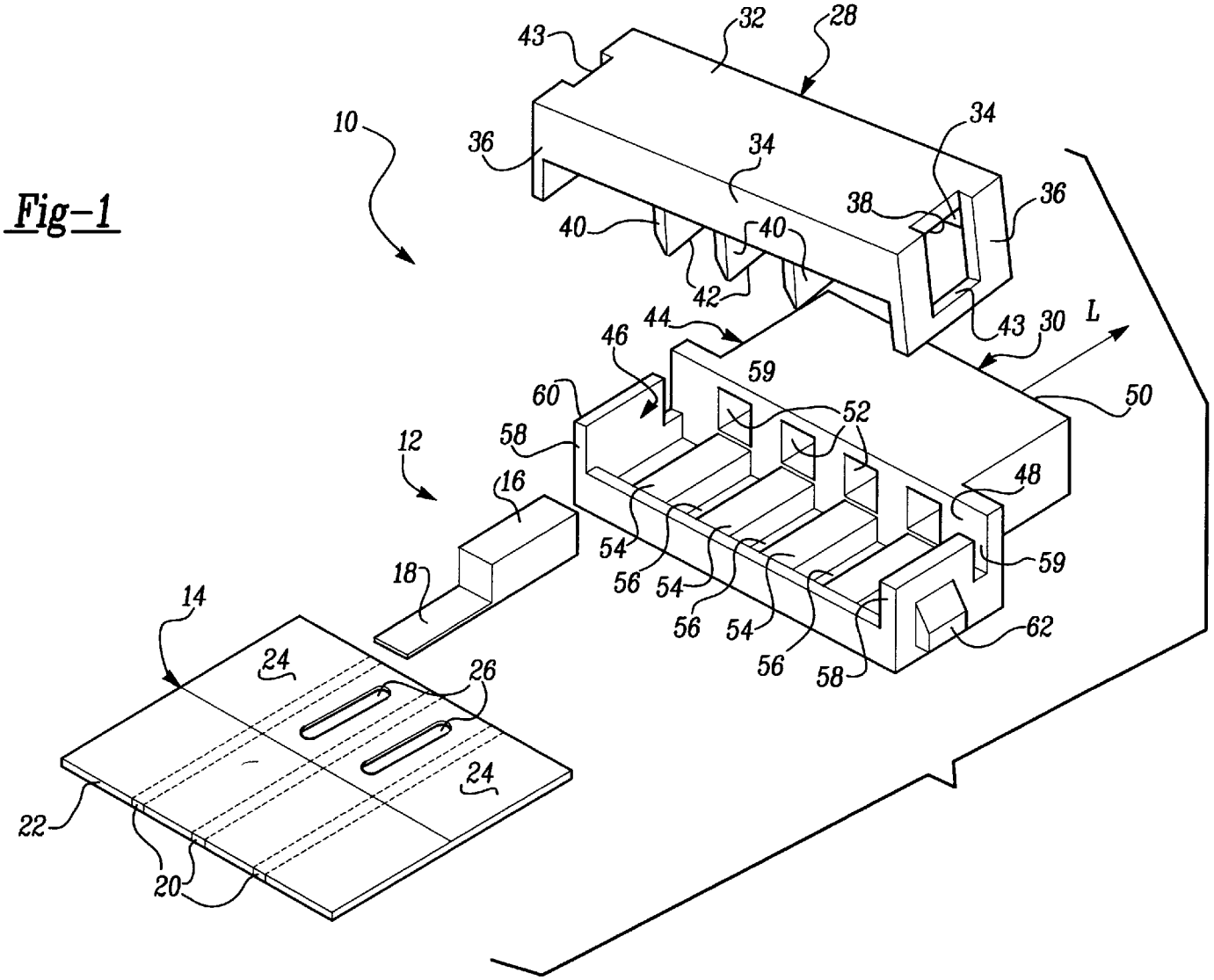
FIG. 1 is a perspective view of a connector of the present invention prior to assembly.

Referring to FIG. 1, a connector 10 is for use with a plurality of terminals, as represented by the terminal 12, and a flat flexible cable 14. The connector 10 has a longitudinally extending axis L.

The terminal 12 generally includes a box-like body portion 16 and an integrally formed extension 18 longitudinally extending therefrom.

The cable 14 includes a plurality of spaced, parallel elongated conductors 20 and an insulating film 22 encasing the conductors 20. The cable area between two conductors is called the web 24. The cable 14 used can have insulation made from any conventional insulation materials so long as it can be pierced and performs satisfactorily as discussed below. Some recommended materials for the insulation are polyester, pen plastic, Mylar (R) or Kapton (R) manufactured by E. I. Dupont de Nemours, Inc., of Wilmington, Del., and the like.

The cable webs 24 have cable openings 26 defined therethrough. These openings 26 are shaped so that the likelihood of the opening propagating longitudinally will be minimized. In this embodiment, the openings 26 are oval or elliptical; however other shapes which achieve the aforementioned purpose can be used.

The connector 10 includes two elements 28 and 30, which form a housing. The first element 28 is an elongated U-shaped structure having a base 32, a first pair of side walls 34, and a second pair of side walls 36. The base 32 has an inner surface 38.

The first pair of side walls 34 extend perpendicularly from the base inner surface 38 and extend along the base width. The second pair of side walls 36 extend perpendicularly from the base inner surface 38 and extend along the base length.

The base inner surface 38 includes a plurality of projections 40. Each projection 40 extends from the inner surface 38 and terminates in a free end 42. The projections 40 are transversely spaced from one another. The number of projections 40 is determined by the amount of force that will be transferred to the connector as to be discussed below.

Each projection 40 includes a sharp tip at the free end 42 and a cross-section between the free end and the inner surface which is shaped, so that propagation of the cable opening 26 will be minimized if a force is applied to the cable once installed in the connector. In this embodiment, the cross-section is oval or elliptical; however other shapes which achieve the aforementioned purpose can be used.

It is critical that the tip at the free end 42 have a surface area small enough to concentrate the force at contact with the cable to cause a controlled tear in the web 24. Any shape, such as conical or angled, will satisfy this requirement.

The second pair of side walls 36 include cutouts 43 extending therethrough.

The second element 30 includes two integrally formed portions 44 and 46. The first portion 44 is a rectangular box-like structure having a front face 48 and a rear face 50. The first portion 44 includes a plurality of spaced rectangular channels 52 which extend longitudinally from the front face 48 to the rear face 50.

The second portion 46 is a rectangular box-like structure which extends longitudinally from the front face 48 of the first portion 44. The second portion 46 has a lower profile than the first portion 44, so that the second element 30 is stepped.

The upper surface 54 of the second portion 46 has a plurality of spaced, longitudinally extending slots 56 disposed therein. The slots 56 are spaced to receive the projections 40 from the first element 28.

The second portion 46 further includes a pair of spaced side walls 58 which extend from the upper surface 54. The side walls 58 each include a cutout 59 adjacent the front face 48 of the first portion 44. The outer surface 60 of the side walls 58 includes an abutment means 62.

It is preferred that the housing be molded from a thermoplastic material, such as glass filled nylon, glass filled polyester and other rigid thermoplastics which are conventionally used for such housings.

Use of the connector 10 will now be discussed. Referring to FIG. 1, the terminals 12 are disposed within the channels 52, so that the extension 18 rests on the upper surface 54 of the second portion 46. The cable 14 is disposed upon the second element 30 so that the slots 56 are aligned with the cable web 24. Conventional means are used to electrically join the conductors 20 to the terminal extensions 18.

The first element 28 is disposed over the second portion 46 of the second element 30. As the projections free ends 42 contact the cable 24 and force is applied the projections 40 cut the openings 26 into the web 24. The first element 28 is brought closer to the second element 30. The projections 40 enter into their associated slots 56. The rearmost side wall 34 enters the cutouts 59. The abutment means 62 is disposed within the cutouts 43.

Once assembled, the cutouts 43 and the abutment means 62 form a locking means, which secures the first element 28 to the second element 30, and consequently the cable 14 on the projections 40. Furthermore, the rearmost first side wall 34 of the first element 28 prevents the terminals 16 from exiting the channels 50, and provides additional retention of the first element 28 to the second element 30 if the abutment means 62 fails. The projections 40 and the slots 52 form a means for retaining the cable within a connector opening (not shown) between the inner surface 38 of the first element and the upper surface 54 of the second element 30.

If a force is applied to the cable 14 urging it away from the connector 10, that force is transferred from the cable 14 to the projections 40, and from the projections 40 to the second element 30 via the projections 40 contacting the second element within the slots 56. Thus, the cable 14 is not permitted to separate from the connector 10. Due to the shape of the cable openings 26 and the cross-sectional shape of the projections 40, this force is not likely to cause the openings 26 to tear.

It is critical that the location of the openings be such that the conductors 20 are undisturbed, so that the electrical performance of the cable 14 is optimized.

The principal advantage of the present invention is that the flat flexible cable can be connected to a connector which provides strain relief and optimal electrical performance.

Several other advantages include that the connector is easy to manufacture and assembly. The connector also is less costly to manufacture than overmold applications due to the stability of the process and material necessary. Furthermore the connector is robust, easy to assemble, fairly simple and the design provides enough mechanical strength to withstand harness formation and assembly to a vehicle.

While a particular invention has been described with reference to illustrated embodiments, various modifications of the illustrative embodiments, as well as additional embodiments of the invention, will be apparent to persons skilled in the art upon reference to this description without departing from the spirit and scope of the invention, as recited in the claims appended hereto. These modifications include, but are not limited to, changing the connector from a two piece design to a one piece design having for example a living hinge for opening and closing the connector. The locking means can be modified in any number of ways to provide the retention of the elements together, including using another plastic part to secure the parts together. The second element can be modified so that the cable exits the connector with a bend to provide additional strain resistance to separation. A conventional fastener, such as the Christmas tree-type, can be added to the connector in order to use the connector as a retainer for securing the cable to the vehicle body. In this embodiment the projections are shaped to form the openings in the cable during connector assembly. In another embodiment the openings in the cable can be preformed during cable manufacture. The projection cross-sectional shape is less critical if the openings are preformed. Thus the cross-sectional shape may be modified to shapes such as beveled or circular. Furthermore, the projections may extend from the first element, the second element or both. The connector may be modified to include a locking finger or other device to retain the terminals. It is therefore contemplated that the appended claims will cover any such modification or embodiments that fall within the true scope of the invention.

We claim:

1. A connector for use with a flat flexible cable, the flat flexible cable having at least one conductor with an insulating film disposed thereabout, the cable further including an opening through the film not contacting the conductor, said connector comprising:

a first element including a plurality of projections extending from one surface of the element and at least one side wall extending from said one surface;

a second element including a first portion having a plurality of spaced partially longitudinally extending slots for receiving the projections and a second portion for receiving a plurality of terminals, said second element including two side walls each having a cut away portion; and a locking means for securing the first element to the second element, upon assembly of the connector the first element is coupled to the second element so that said first element side wall is at least partially received within said cut away portions on said second element and an opening is formed between said first and second elements for receiving the cable and the projections extend through the openings in the cable and are disposed within the respective slots.

2. The connector of claim 1, wherein said projections are sharp enough to form the opening in the cable when the projection is passed through the cable.

3. The connector of claim 1, wherein said projections have an oval cross-section.

4. The connector of claim 1, wherein said projections have an elliptical cross-section.

5. The connector of claim 1, wherein said locking means includes a tab member on said second element and a receiving portion on said first element that receives said tab member when the first element is coupled to the second element.

6. A connector assembly, comprising:

a flat cable having a plurality of longitudinally extending conductor portions and an insulating film surrounding said conductor portions with web portions extending between adjacent conductors;

a first connector element having a plurality of spaced projections extending from a first surface, said projections being spaced apart in a transverse direction relative to the longitudinal axis of the conductors, said projections extending through corresponding web portions of said insulating film;

a second connector element having a body with a plurality of openings that receive at least a portion of said projections, each said opening having an abutment surface that abutingly engages a corresponding surface on an associated one of said projections when the first connector element is coupled to the second connector element; and wherein said first connector element includes a side wall extending from said first surface and said second connector elements includes a cut away portion in said body that receives at least a portion of said side wall when said first connector element is coupled with said second connector element and wherein said side wall on said first element is on an opposite side of said projections from said abutment surfaces.

7. The assembly of claim 6, wherein said web portions include predefined longitudinally extending openings for receiving said projections.

8. The assembly of claim 6, wherein said openings in said web portions have a generally rounded contour at opposite longitudinal ends of said openings and wherein said projections have correspondingly rounded contours at opposite longitudinal ends of said projections such that said projections fit snugly within said openings.

9. The assembly of claim 6, further comprising a locking mechanism for securing the first connector element to the second connector element and wherein the locking mechanism comprises a tab on one of said connector elements and a tab receiver on the other of said connector elements such that the tab engages the tab receiver when the first connector element is coupled with the second connector element.

* * * * *